United States Patent [19]

Lilly et al.

[11] 3,981,292

[45] Sept. 21, 1976

[54] HEATER

[75] Inventors: Wilbur E. Lilly; David A. Rogers, both of Mount Gilead, Ohio

[73] Assignee: Lilly Industries, Inc., Mount Gilead, Ohio

[22] Filed: July 24, 1975

[21] Appl. No.: 598,720

[52] U.S. Cl. ..... 126/121; 126/123; 126/126; 126/137

[51] Int. Cl.[2] ..... F24B 1/26

[58] Field of Search ..... 126/121, 123, 126, 129, 126/200, 137

[56] References Cited

UNITED STATES PATENTS

| | | | |
|---|---|---|---|
| 253,969 | 2/1882 | Brecher | 126/123 |
| 1,255,493 | 2/1918 | Williams | 126/123 |
| 1,470,542 | 10/1923 | Poling | 126/137 |
| 1,747,259 | 2/1930 | Pierce | 126/121 |
| 2,671,440 | 3/1954 | Dupler | 126/121 |
| 2,743,720 | 5/1956 | Dollinger | 126/121 |
| 3,834,370 | 9/1974 | Nelson | 126/137 |

*Primary Examiner*—John J. Camby
*Assistant Examiner*—Larry I. Schwartz
*Attorney, Agent, or Firm*—Sidney W. Millard

[57] ABSTRACT

A generally rectangular shaped heater having an open front and a pyramid shaped roof is designed with a double wall at its rear section. Air is blown into the cavity between the two walls where it absorbs heat and is thereafter expelled through ducts which project through the front of the heater. A grate is recessed in a horizontal opening below the open front of the heater and damper means are provided to admit air below the grate and thereby facilitate the combustion of the material deposited on the grate. Air passes into the heater below the grate, up through the grate, upward against the inner surface of the rear wall which is sloped forwardly, up around the ducts to the roof section of the heater and rearwardly to exit at a flue.

10 Claims, 4 Drawing Figures

HEATER

BACKGROUND OF THE INVENTION

With the recent fuel crisis in the United States it has become desirable to have available an alternate source of heating for basements, garages, or small workshops. The traditional "pot-bellied stove" and the like have been used for this purpose over many years of effective use and no doubt they will continue to be used. However, its heating capacity is not particularly efficient and this invention is designed to burn all of the conventional solid fuels to give a greatly increased efficiency in operation. Properly used, the heater of this invention will greatly reduce the amount of fuel consumed by existing conventional systems and will serve to give minimum heat during temporary stoppages of the conventional system.

SUMMARY OF THE INVENTION

A generally rectangular fire box having a pyramid shaped top is constructed to maximize heat transfer through the walls of the fire box but without causing the smoke from combustion to "roll" out into the room being heated. The rear wall of the heater is a double walled structure with the exterior wall being generally vertical and having an aperture therethrough to accommodate a blower. The internal rear wall surface is composed of three panels which may be formed separately and joined together or, if desired, integrally as one piece. The upper and lower panels are generally vertically extending and the middle panel bridges the gap between the two at an inclined angle where the middle panel extends forwardly and upwardly at an angle of about 4° from the horizontal.

Hot air ducts extend through the upper panel to collect air from the area between the double walls and will convey air through the front of the heater to heat the room where the duct terminates.

An ash pan or drawer projects through an opening in the lower front portion of the heater to catch ash which may fall from a grate. The grate is mounted in a horizontal opening located just below a larger opening in the heater front. Fuel will be deposited on the grate through the first or larger opening, burned to ash, and removed in the pan through the second or smaller opening.

Damper means are provided in the front face of the drawer such that fresh air from outside the heater will pass into the heater below the grate and thereafter be drawn upward into the grate area for enhancing the combustion of the solid fuel lying on the grate. The oxygen from the air will keep the fuel burning vigorously when the damper is open to the fullest. Obviously, if one wishes to slow down the combustion, he need only adjust the opening of the damper.

At times when burning is occurring, the flames and/or combustion gases will impinge on the sloping inner surface of the rear wall thereby heating the wall and transferring heat to the air inside the cavity between the double rear wall. The blower mounted on the exterior of the rear wall is designed to cause air to impinge about the middle of the sloping wall and cause rolling turbulence within the cavity. The greater the turbulence the greater will be the heat transferred to the air. The heated air will move upward to the duct area and will be conveyed out of the heating cavity to the front of the heater. The combustion gases moving upward to the front, beyond the sloping surface, will pass around the hot air ducts and even greater amounts of heat will be transferred to the air by this mechanism.

As the combustion gases pass on upward they will strike the converging pyramid shaped roof and be directed rearwardly again toward the flue which is located roughly above the exterior rear wall.

As can be seen, the sinuous path traveled by the combustion gases from the grate to the exit through the flue will contribute to greater heat transfer to the walls of the heater and thereby increase the overall efficiency of the heater itself.

DESCRIPTION OF THE PREFERRED EMBODIMENT

Figure 1:
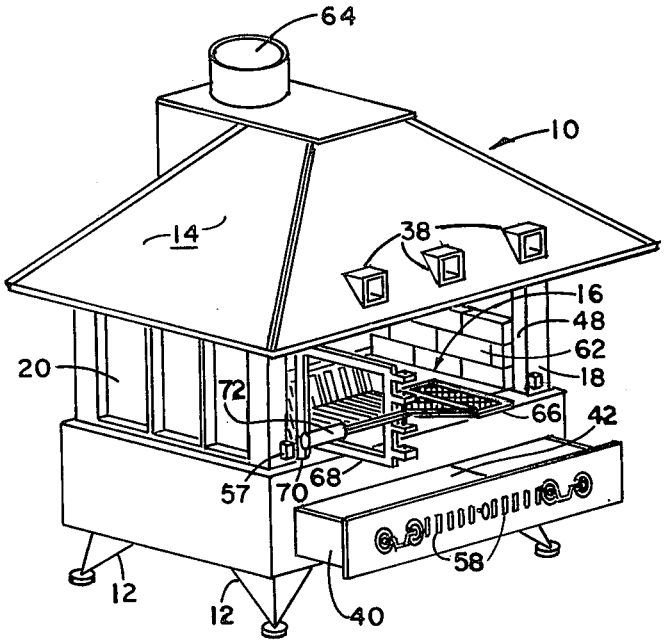
FIG. 1 is a perspective view of the heater of this invention with a grill mounted on the front.

The heater of this invention indicated generally at 10 is mounted above a substrate (not shown) on legs 12 and is generally rectangular in shape with a pyramid shaped roof or top 14. The peak area of the roof 14 is flat to provide appropriate flow capacity to the rear flue and to prevent a trapped pocket of combustion gases.

A fire box 16 is formed by a front 18, side walls 20, and a rear wall indicated generally at 22. As will be clear from an observation of FIG. 4, the side walls 20 are in fact a double walled structure and by this mechanism the side walls are prevented from becoming "red hot" during the time of the greatest heat of the heating season.

Figure 4:
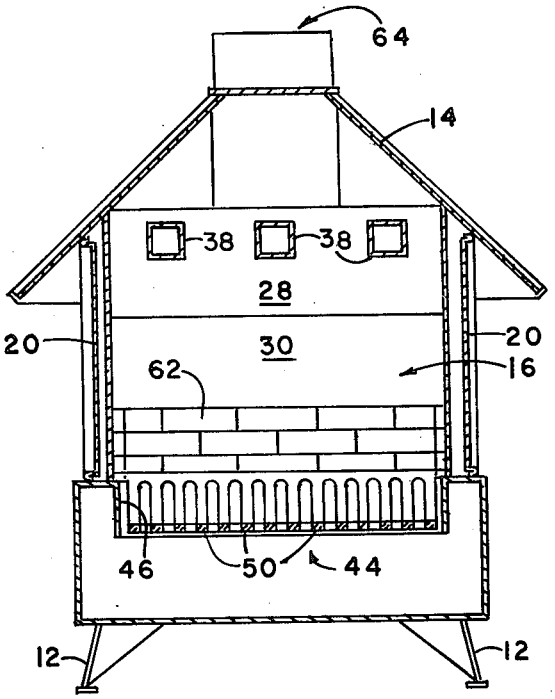
FIG. 4 is a sectional view taken along line 4—4 of FIG. 3.
Figure 2:
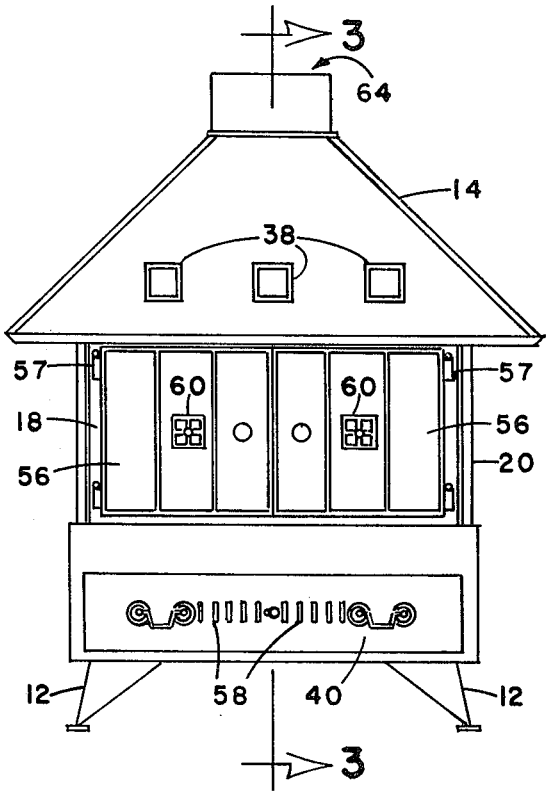
FIG. 2 is a front elevational view of the heater of this invention showing closed doors on the front.
Figure 3:
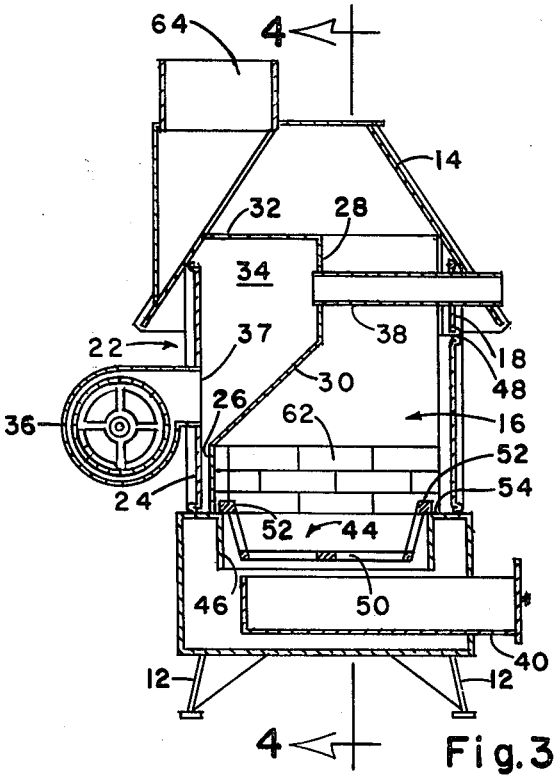
FIG. 3 is a sectional view of the heater taken along line 3—3 of FIG. 2.

Observing FIG. 4, the rear wall 22 consists of a vertically extending exterior panel 24 and an inwardly spaced interior surface consisting of three panels which may conveniently be formed of a single piece. The lower panel 26 is generally vertical as is the upper panel 28. The middle or immediate panel 30 is inclined at an angle of about 41° above the horizontal to bridge the space between panels 26 and 28. Horizontal panel 32 serves to enclose the top of the space or cavity 34 formed by the various panels of the rear wall 22.

A blower 36 is mounted on the vertical panel 24 to blow air through an aperture 37 in panel 24 and cause it to impinge at approximately the middle of intermediate panel 30. This will cause the air to roll and tumble and considerable turbulence will occur before the rolling air rises and exits through one of the plurality of hot air ducts or conduits 38.

It will be observed that conduits 38 are in fluid communication with the cavity 34 and extend forwardly through the front 18 and also through the sloping front portion of the pyramid shaped roof 14. The pyramid shape of the top is designed to collect any smoke which may accidentally exit from the heater and as a consequence, it is not critical that the roof 14 be joined by fluid tight welding completely around the periphery. The shape of the roof and the flue itself will tend to draw any escaping smoke back up under the roof section. For this reason, the hot air ducts 38 are caused to project to a point above the lowest portion of the roof and thereby no heat will be inadvertently lost by having it drawn back into the heater itself. The outward projection of the roof is also a safety feature in that, it keeps workmen from walking too close and brushing against the hot heater walls.

The lower section of the heater includes an ash pan 40 which is designed to slide into place through an opening 42 in the lower front section of the heater. Thereby, it will be located below a grate indicated generally at 44. The grate is designed to be mounted in a horizontal opening 46 which is below the larger opening 48 in the upper front section of the heater. Opening 48 opens directly into the fire box 16 and serves the prime function of providing access to the grate for the deposition of solid fuel. The grate is composed of steel bars 50 of generally U-shaped configuration, best seen in FIG. 4, which are attached at their ends to straight horizontal bars 52.

The opening 46 forms shoulders 54 and the bars 52 rest on the shoulders, thereby the grate is recessed about 4 inches below the front opening 48 which provides greater fuel capacity. In this manner, any solid combustible fuel which might be deposited on the grate through the opening 48 will not have a tendency to roll back out into the room. Additionally, sparking and coals popping into the room are minimized. To further minimize the sparking and to minimize fresh air above the flame, doors 56 are pivotally mounted at 57 at the sides of the opening 48 and the doors may be swung into closed position to completely fill the opening if desired.

Below fire dampers 58 are shown as part of the front face of the ash pan 40 and it is clear that above fire dampers 60 may be installed in the doors 56. Above fire dampers 60 are usually used at the time of starting the fire to increase the oxygen and maintain combustion. After the fire is going well and the hot walls assisting in radiation heat back to the combustion area, the dampers 60 will conventionally be closed to increase efficiency such that only the below fire dampers 58 will be open to receive outside air. Along this line, FIG. 4 illustrates fire brick 62 which covers the lower portion of the fire box up to approximately the height of the lowermost panel 26. The bricks are optional features. Fire or ceramic brick in this area tend to radiate heat back to the combustion area and assist in maintaining even combustion of the fuel over long periods. It has been found that on leaving the heater burning at night when dampers 60 are closed and dampers 58 only slightly open, the fire may be maintained in the heater for long periods and the fire brick tends to be most effective in maintaining the continuance of the fire. This is believed to be because of the radiant heat back to the combustible fuel itself and the maintenance of overall higher temperatures with the same amount of heat generated by the burning fuel.

The heater of this invention is particularly designed to provide a sinuous or twisting path for the hot gases of combustion to maximize the heat transferred from the combustion gases to the surfaces of the heater itself. In line with this, it will be observed, particularly in FIGS. 1 and 4, that the flue opening 64 is located at the rearmost portion of the heater such that a plane which includes the exterior panel 24 would pass through the flue 64. The location of the flue serves to elongate the heat transfer passage through the heater. The combustion gases move upward from the grate to the sloping panel 30, forwardly and upwardly along panel 30, then vertically around the duct 38, upwardly and reawardly along the roof section 14 and out through the flue 64.

An alternative embodiment is illustrated in FIG. 1 wherein a grill 66 is pivotally mounted on an arm 68 which in turn is pivotally mounted at 70 in place of one of the doors 56. The fact that both ends of the arm 68 allow free pivoting movement also serves to allow one to grasp the handle 72 of the grill and locate it any place within the heater. For example, if the fire is burning more hotly on one side than the other, then one who might want to grill hamburgers might move the grill surface to the opposite less hot side of the heater.

In operation, after the heater has been burning for some period of time, the doors 56 will be closed so that heat from the room will not be drawn in through opening 48 and out through the flue 64. The dampers 60 will be closed and the dampers 58 will be open. Air from the outside will pass in through dampers 58 beneath the grate 44, up through the grate to provide oxygen for combustion and then up to impinge on the sloping panel 30. The panel 30 is inclined no more than about 41° from the horizontal for the reason that the maximum in flame contact with panel 30 is desirable to transfer as much heat as possible, but by the same token, when smoke contacts an obstruction it tends to roll. If the obstruction is too transverse to the normal flow of the smoke, the smoke will simply roll out into the room with the obvious detrimental result. It has been discovered that in the general combination of structure as described herein, where the inclination is 41° or greater the smoke will not roll out into the room. Obviously, if the angle of inclination is too great the heat will simply flow upward quickly and out through the flue without the desired transfer to the heater walls.

It will also be observed that the panel 28 is approximately at the centerline of the fire box or structurally about the centerline of the opening 46. Where the forward projection of the panel 30 is beyond the centerline, the smoke tends to roll into the room and where it is too much recessed from the centerline toward the rear, the heat tends to be lost to the flue. The longer the flame is maintained in impinging contact with the sloping surface 30, the more heat will be transferred.

After the hot combustion gases leave the surface 30 they move upward around the hot air ducts 38 where more heat is transferred. Subsequently, the combustion gases rise into the pyramid shaped roof area where they are deflected to the rear and out the flue 64.

Having thus described the invention in its preferred embodiment it will be obvious to those having ordinary skill in the art that modifications may be made to the structure without departing from the spirit of the invention. Accordingly, it is not the intention of the inventors to be limited by the drawings illustrating the preferred embodiment nor the language used to describe the same. Rather it is the intention of the inventors to be limited only by the scope of the appended claims.

We claim:

1. A heater including a front, two side walls and a rear wall joined together to form a fire box, the front including a first opening for allowing the deposition of combustible material on a grate, said grate comprising a plurality of U-shaped metallic bars aligned parallel to each other and joined at their ends to straight bars extending perpendicular to said U-shaped bars, said U-shaped bars having been deformed downwardly between said straight bars to thereby define a generally wide U-shape, means forming a rectangular horizontal opening within said fire box below the first opening in the front, the grate being supported in said opening by said straight bars resting on the means forming the rectangular horizontal opening, a second opening in the front below the first opening, an ash pan extending through the second opening below the grate to catch falling ashes, damper means for admitting air below the grate, the rear wall including a vertically extending exterior panel spaced from an interior surface, said interior surface comprising three planer panels, the upper and lower of the three panels extending parallel with said exterior panel, the middle panel extending forwardly and upwardly to fill the space between the upper and lower panels, a top attached to the top surfaces of the front, the side walls, and the exterior panel, said top extending outward and below said top surfaces, and a flue opening through the top wherein a plane including said exterior panel passes through said flue opening, a plurality of hot air ducts extending in fluid communication through both the front and said portion of said top outward of said front from the space between the interior surface and the exterior panel of the rear wall to provide freer flow of hot air to the area to be heated and air blower means mounted on said exterior panel for moving air from outside the fire box through an aperture in the exterior panel into the space between the interior surface and the exterior panel where it may be heated and conducted through the ducts to heat the area forward of the front.

2. The heater of claim 1 wherein the upper panel of the interior surface of the rear wall lies in a vertical plane bisecting the horizontal opening supporting the grate.

3. The heater of claim 2 including pivotable door means mounted for swinging into and closing the first front opening,

4. The heater of claim 3 including damper means in said door means for admitting outside air above the grate.

5. The heater of claim 1 including fire brick lining the fire box side of the lower of the three panels defining the interior surface of the rear wall.

6. The heater of claim 1 wherein the angle of inclination of the middle panel is not substantially greater than 41° above the horizontal.

7. The heater of claim 1 including means for mounting a pivotable grill adjacent the front, said mounting means including an arm extending from the front, said arm being pivotable with respect to said front and the grill being pivotable with respect to said arm.

8. The heater of claim 1 including pivotable door means mounted for swinging into and closing the first front opening.

9. The heater of claim 3 including damper means in said door means for admitting outside air above the grate.

10. The heater of claim 3 wherein the angle of inclination of the middle panel is not substantially greater than 41° above the horizontal.

* * * * *